US012663002B2

(12) United States Patent
Hironaka et al.

(10) Patent No.: US 12,663,002 B2
(45) Date of Patent: Jun. 23, 2026

(54) ELECTRIC PUMP SYSTEM

(71) Applicant: KYB Corporation, Tokyo (JP)

(72) Inventors: Tsuyoshi Hironaka, Kanagawa (JP); Ken Tsukui, Kanagawa (JP); Kazunari Suzuki, Kanagawa (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 18/852,447

(22) PCT Filed: Jan. 10, 2023

(86) PCT No.: PCT/JP2023/000324
§ 371 (c)(1),
(2) Date: Sep. 28, 2024

(87) PCT Pub. No.: WO2023/188676
PCT Pub. Date: Oct. 5, 2023

(65) Prior Publication Data

US 2025/0215872 A1 Jul. 3, 2025

(30) Foreign Application Priority Data

Mar. 31, 2022 (JP) ..... 2022-059450

(51) Int. Cl.
*F04B 49/22* (2006.01)
*F04B 17/03* (2006.01)
*F04B 49/20* (2006.01)

(52) U.S. Cl.
CPC ..... *F04B 49/225* (2013.01); *F04B 17/03* (2013.01); *F04B 49/20* (2013.01); *F04B 2203/0206* (2013.01); *F04B 2203/0209* (2013.01)

(58) Field of Classification Search
CPC ..... F04B 49/225; F04B 17/03; F04B 49/20; F04B 2203/0206; F04B 2203/0209; F04B 2205/09; F04B 49/10
See application file for complete search history.

(56) References Cited

U.S. PATENT DOCUMENTS 4,953,109 A * 8/1990 Burgis ..... B30B 15/26 53/529
5,687,567 A * 11/1997 Hansson ..... B30B 15/161 60/431

(Continued)

FOREIGN PATENT DOCUMENTS

EP 2034186 A2 3/2009
EP 2034186 A3 7/2011

(Continued)

*Primary Examiner* — Hoang M Nguyen
(74) *Attorney, Agent, or Firm* — Rabin & Berdo, P.C.

(57) ABSTRACT

An electric pump system includes: a pump configured such that a discharge flow rate is controlled in accordance with an opening degree of a solenoid valve, the operation of the solenoid valve being controlled by energization; an electric motor configured to drive the pump; and a control device configured to control the operations of the solenoid valve of the pump and the electric motor based on the command signal indicating the required discharge flow rate or the required discharge pressure of the pump. The control device is configured to adjust the operations of the solenoid valve and the electric motor when the determination condition, which is for determination of whether a predetermined vibration is generated in the electric pump system or the CVT, is satisfied.

6 Claims, 8 Drawing Sheets

(56) References Cited

U.S. PATENT DOCUMENTS

| | | | | |
|---|---|---|---|---|
| 2007/0204603 | A1* | 9/2007 | Jacobs | F15B 21/087 60/428 |
| 2013/0318956 | A1* | 12/2013 | Yunoue | E02F 9/2285 60/431 |
| 2017/0320368 | A1* | 11/2017 | Masamura | B60G 17/015 |
| 2018/0326810 | A1* | 11/2018 | Masamura | B60G 17/0165 |

FOREIGN PATENT DOCUMENTS

| | | | | |
|---|---|---|---|---|
| JP | H09-068172 | A | | 3/1997 |
| JP | 2020026832 | A | * | 2/2020 |

* cited by examiner

ELECTRIC PUMP SYSTEM

TECHNICAL FIELD

The present invention relates to an electric pump system.

BACKGROUND ART

JP1997-68172A discloses an electric motor driven type pump device in which a variable displacement pump is driven by an electric motor. In this electric motor driven type pump device, the pump is a variable displacement vane pump, and a switching valve for moving and displacing a cam ring is provided. By controlling operation of the switching valve, the pump discharge capacity is controlled.

SUMMARY OF INVENTION

In the electric pump device as described in JP1997-68172A, the operation is controlled such that working fluid is supplied at the flow amount or pressure required to a driving target object. With this electric pump device, it is also required not only to supply the required working fluid to the driving target object, but also to suppress vibration and noise thereof.

As object of the present invention is to provide an electric pump system capable of suppressing vibration.

According to one aspect of the present invention, an electric pump system for supplying working fluid to a driving target object, and the electric pump system comprising: a pump configured such that a discharge flow rate is controlled in accordance with an opening degree of a solenoid valve, operation of the solenoid valve being controlled by energization; an electric motor configured to drive the pump; and a control device configured to control operations of the solenoid valve of the pump and the electric motor based on a command signal indicating a required discharge flow rate or a required discharge pressure of the pump, wherein the control device is configured to adjust the operation of at least one of the solenoid valve and the electric motor when a determination condition is satisfied, the determination condition being set based on vibration generated in the electric pump system or the driving target object.

DESCRIPTION OF EMBODIMENTS

In the following, an electric pump system 100 according to an embodiment of the present invention will be described with reference to the drawings.

First Embodiment

The electric pump system 100 is a device that supplies working fluid (working oil in this embodiment) to a driving target object (a fluid pressure apparatus) that is operated by the working fluid. In the following, a case in which the electric pump system 100 is mounted on a vehicle V, and the working oil is supplied to a transmission, which includes a belt-driven type continuously variable transmission mechanism (hereinafter, referred to as "CVT 2"), serving as the driving target object will be described as an example. The driving target object may also be a fluid pressure control device of a construction machine, an automatic transmission of a vehicle, or the like.

Figure 1:
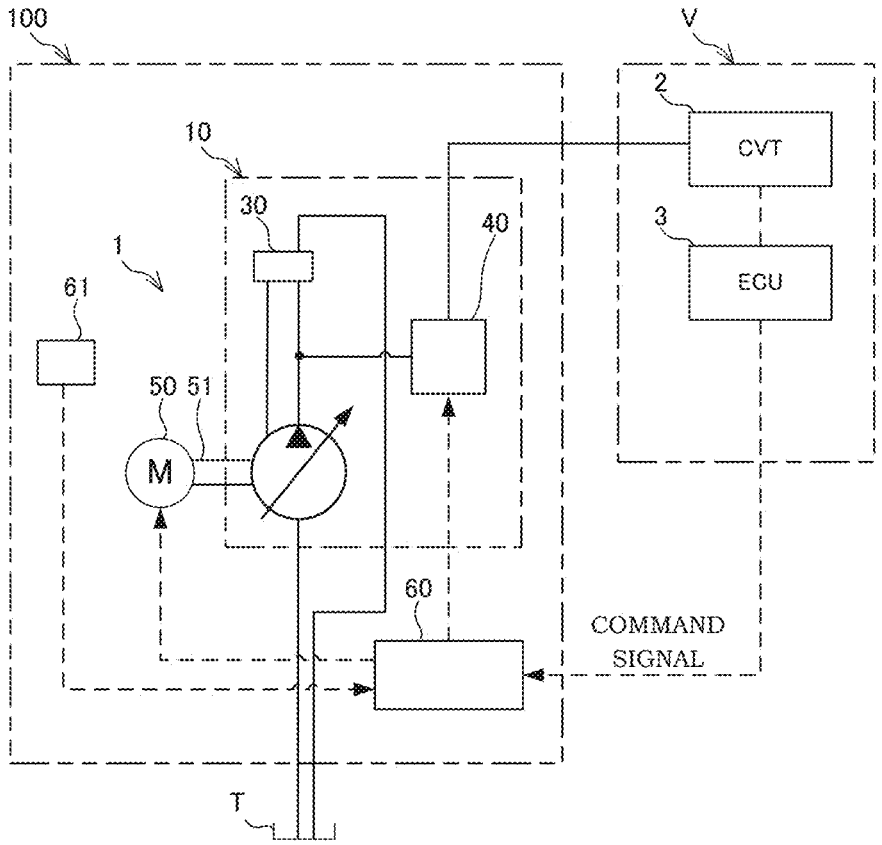
FIG. 1 is a block diagram showing a configuration of an electric pump system according to a first embodiment of the present invention.

As shown in FIG. 1, the electric pump system 100 receives a command signal for controlling operation of a CVT 2 from an ECU 3 of the vehicle V, and supplies the working oil to the CVT 2 in accordance with the command signal. The electric pump system 100 includes: a pump 10 of a variable displacement type; an electric motor 50 that drives the pump 10; an acceleration sensor 61 serving as a vibration detection unit that detects vibration of an electric pump 1 that is configured with the pump 10 and the electric motor 50; and a control device 60 that controls operations of the pump 10 and the electric motor 50.

Figure 2:
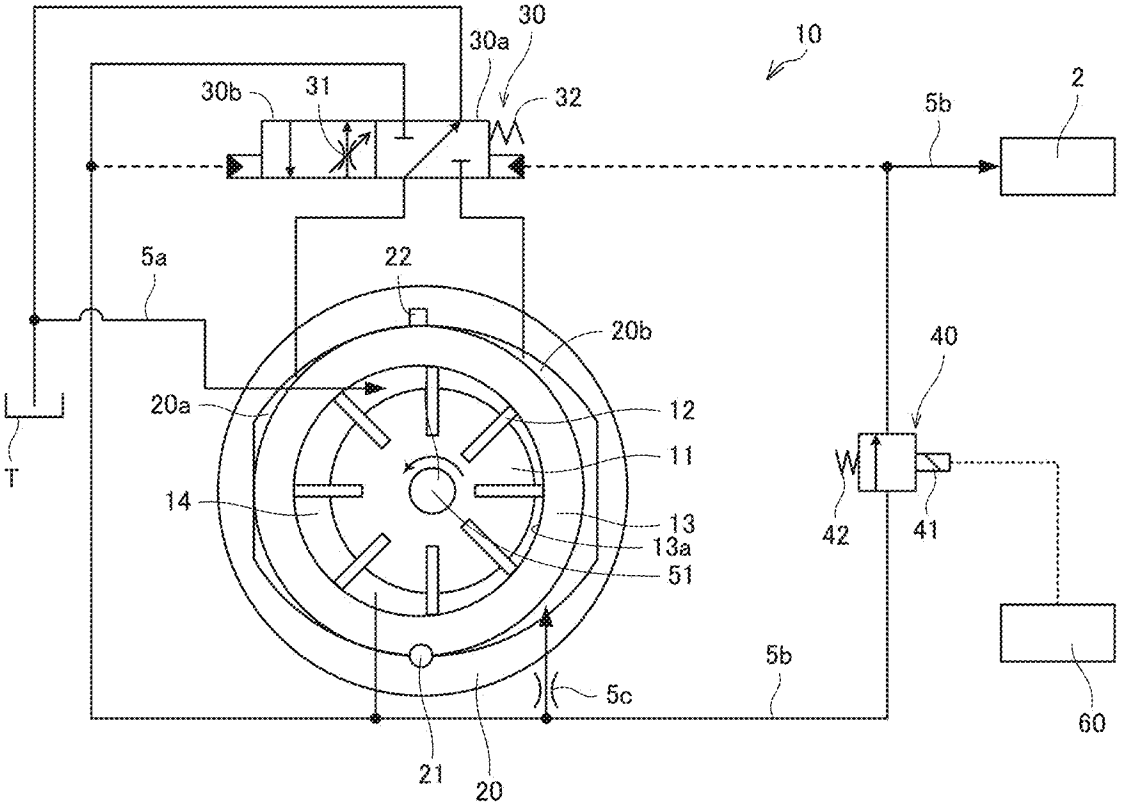
FIG. 2 is a block diagram showing a configuration of a pump according to the first embodiment of the present invention.

The pump 10 is a variable displacement vane pump. In addition, the pump 10 is an unbalanced vane pump. As shown in FIG. 2, the pump 10 includes: a rotor 11 that is rotationally driven; a plurality of vanes 12 that are provided in the rotor 11 so as to be reciprocatable in the radial direction; and a cam ring 13 that accommodates the rotor 11 and the vanes 12. The rotor 11 is linked to a rotation shaft 51 of the electric motor 50 and is rotated together with the rotation shaft 51 of the electric motor 50.

The vanes 12 are biased radially outward by a back pressure applied to the vanes 12 and a centrifugal force caused by the rotation of the rotor 11, and tip end portions of the vanes 12 slide along an inner circumferential surface 13*a* of the cam ring 13. The rotor 11 and the cam ring 13 are provided between a pump body (not shown) and a pump cover (not shown), and a plurality of pump chambers 14 are formed between the rotor 11 and the cam ring 13 by being partitioned by the respective vanes 12.

The cam ring 13 is decentered relative to the center of the rotor 11. Therefore, the vanes 12 reciprocate along with the rotation of the rotor 11, and thereby, the pump chambers 14 are expanded and contracted. As the pump chambers 14 expand, the working oil in a tank T is sucked into the pump chambers 14 through a suction passage 5*a* and a suction port (not shown). As the pump chambers 14 contract, the working oil is discharged from the pump chambers 14 through a discharge port (not shown). The discharged working oil is supplied to the CVT 2 by being guided by a discharge passage 5*b*.

A displacement volume (a discharge capacity) of the pump 10 changes in response to an amount of eccentricity of the cam ring 13. Specifically, as the amount of eccentricity is reduced, the displacement volume is reduced. As the amount of eccentricity is increased, the displacement volume is increased. The displacement volume corresponds to discharge amount of the working oil per rotation of the rotor 11. FIG. 2 shows a state in which the cam ring 13 is decentered to the maximum extent, and the displacement volume of the pump 10 is the maximum.

The pump 10 includes an annular adapter ring 20 that surrounds the cam ring 13; a control valve 30 that controls the pressure between the cam ring 13 and the adapter ring 20; and a solenoid valve 40 that controls the operating characteristics of the control valve 30.

The adapter ring 20 supports the cam ring 13 so as to be swingable via a support pin 21. As the cam ring 13 swings relative to the adapter ring 20, the amount of eccentricity with respect to the center of the rotor 11 is changed.

A space between the cam ring 13 and the adapter ring 20 is divided into a first fluid pressure chamber 20*a* and a second fluid pressure chamber 20*b* by the support pin 21 and a seal member 22 that is provided on an inner circumference of the adapter ring 20. When the cam ring 13 swings in the direction in which the first fluid pressure chamber 20*a* is expanded and the second fluid pressure chamber 20*b* becomes smaller (the right direction in FIG. 2), the amount of eccentricity is reduced. When the cam ring 13 swings in the direction in which the first fluid pressure chamber 20*a* becomes smaller and the second fluid pressure chamber 20*b* is expanded (the left direction in FIG. 2), the amount of eccentricity is increased.

The swing of the cam ring 13 is caused by a pressure difference between the first fluid pressure chamber 20*a* and the second fluid pressure chamber 20*b*. The first fluid pressure chamber 20*a* and the second fluid pressure chamber 20*b* are connected to the tank T via the control valve 30, and the pressure in each of the first fluid pressure chamber 20*a* and the second fluid pressure chamber 20*b* is controlled by using the control valve 30. The second fluid pressure chamber 20*b* is connected to the discharge passage 5*b* at the upstream side of the solenoid valve 40 via a fixed restrictor 5*c*.

The control valve 30 is selectively switched between a first position 30*a* or a second position 30*b* in response to the pressure difference between the upstream side and the downstream side of the solenoid valve 40. At the first position 30*a*, the control valve 30 allows the communication between the first fluid pressure chamber 20*a* and the tank T, and on the other hand, shuts off the communication between the second fluid pressure chamber 20*b* and the tank T. At the second position 30*b*, the control valve 30 shuts off the communication between the first fluid pressure chamber 20*a* and the tank T, and on the other hand, allows the communication between the second fluid pressure chamber 20*b* and the tank T via a variable restrictor 31. The variable restrictor 31 is formed such that an opening area is increased as the pressure difference between the upstream side and the downstream side of the solenoid valve 40 is increased.

The solenoid valve 40 adjusts an opening degree of the discharge passage 5*b* in accordance with the current supplied from the control device 60. By adjusting the opening degree of the discharge passage 5*b*, the pressure difference between the upstream side and the downstream side of the solenoid valve 40 is adjusted. The solenoid valve 40 has a solenoid 41 that biases a valve body (not shown) in the direction in which the discharge passage 5*b* is closed and a spring 42 that biases the valve body against the solenoid 41.

When the pressure difference between the upstream side and the downstream side of the solenoid valve 40 is smaller than a predetermined value, the control valve 30 is maintained at the first position 30*a* by a biasing force exerted by a return spring 32.

At this time, the first fluid pressure chamber 20*a* communicates with the tank T via the control valve 30, and the pressure in the first fluid pressure chamber 20*a* becomes equal to the tank pressure. On the other hand, the communication between the second fluid pressure chamber 20*b* and the tank T is shut off by the control valve 30. Because the working oil in the discharge passage 5*b* is guided to the second fluid pressure chamber 20*b*, the cam ring 13 is biased in the left direction in FIG. 2 by the pressure in the second fluid pressure chamber 20*b* and is held at the position where the cam ring 13 is decentered to the maximum extent. As a result, the displacement volume of the pump 10 is maximized.

When the pressure difference between the upstream side and the downstream side of the solenoid valve 40 reaches a predetermined value due to an increase in the rotation rate of the rotor 11 or an increase in the amount of current supplied the solenoid 41, the control valve 30 is switched to the second position 30*b*. Thus, the control valve 30 shuts off the communication between the first fluid pressure chamber 20*a* and the tank T, and on the other hand, allows the communication between the first fluid pressure chamber 20*a* and the discharge passage 5*b*. Therefore, the pressure in the first fluid pressure chamber 20*a* is increased. In addition, the control valve 30 allows the communication between the second fluid pressure chamber 20*b* and the tank T via the variable restrictor 31. Therefore, the pressure in the second fluid pressure chamber 20*b* is reduced, and the cam ring 13 swings to the right direction in FIG. 1 by the pressure in the first fluid pressure chamber 20*a*. As a result, the amount of eccentricity is reduced, and the displacement volume of the pump 10 is reduced.

As described above, in the electric pump system 100, by controlling the rotation rate of the rotor 11 (the rotation rate of the electric motor 50) and the amount of current supplied to the solenoid valve 40, it is possible to adjust the displacement volume of the pump 10 to adjust the discharge flow rate of the pump 10.

The acceleration sensor 61 is attached to a position where vibration generated in the electric pump 1 can be measured. For example, the acceleration sensor 61 is provided on a bracket portion (not shown) with which the electric motor 50 is attached to the vehicle V. The position to which the acceleration sensor 61 is attached is not limited thereto, and it may be set arbitrarily. However, it is desirable to detect the vibration at a position as close to the vehicle V (a mother unit) as possible. In addition, the acceleration sensor 61 may be attached to both of the electric motor 50 and the pump 10. A detection result (the amplitude) from the acceleration sensor 61 is input to the control device 60. The acceleration sensor 61 may be provided on the side of the vehicle V such as the CVT 2, etc., which is the driving target object.

The control device 60 is an ECU configured with a microcomputer including a CPU (a central processing unit), a ROM (a read-only memory), a RAM (a random-access memory), and an I/O interface (an input/output interface). The RAM stores data for processing executed by the CPU, the ROM pre-stores a control program, etc. for the CPU, and the I/O interface is used for input/output of information to/from a device connected to the control device 60. The control device 60 is programmed to be capable of executing at least a process necessary for executing the control according to this embodiment and modifications. The control device 60 may be configured as a single device, or may be configured to be divided into a plurality of devices such that controls are respectively executed by the plurality of devices in a distributed processing.

The control device 60 controls the operations of the electric motor 50 and the pump 10 so as to be capable of executing the control method of the electric pump 1 described in this description.

Figure 3:
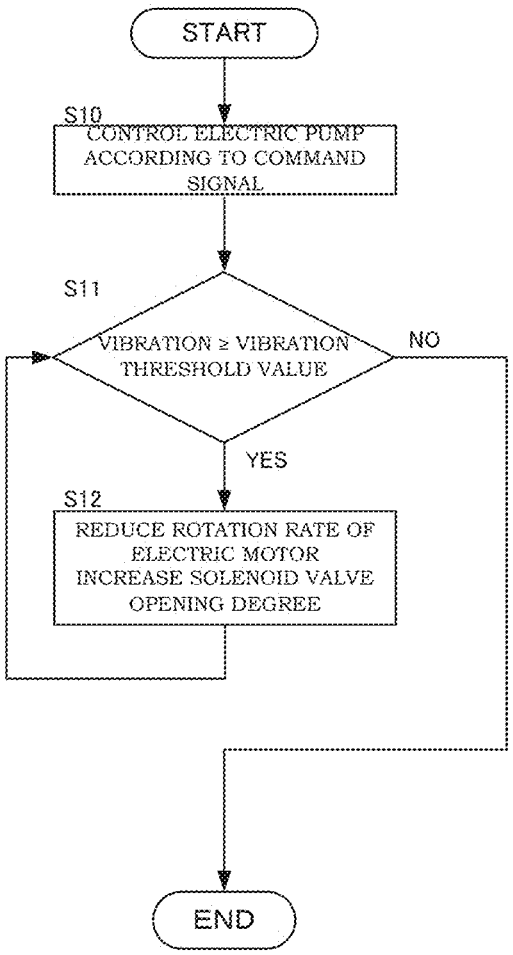
FIG. 3 is a flowchart showing a control method according to the first embodiment of the present invention.

FIG. 3 is a flowchart showing the control method of the electric pump 1 executed by the control device 60. When, for example, an ignition switch of the vehicle V is turned ON, and the electric pump system 100 is activated, the control device 60 executes the processing shown in FIG. 3 at predetermined time intervals.

In step S10, the rotation rate of the electric motor 50 and the opening degree of the solenoid valve 40 are adjusted so as to achieve the flow amount and the pressure in accordance with the command signal.

In step S11, it is determined whether or not the determination condition, which is set on the basis of the vibration generated in the electric pump 1, is satisfied. Specifically, the determination condition is whether the vibration detected by the acceleration sensor 61 is equal to or greater than a predetermined vibration threshold value. For example, the vibration threshold value corresponds to a value of the amplitude of the vibration when resonance is caused in the electric pump 1. If the vibration detected by the acceleration sensor 61 is equal to or greater than the vibration threshold value, it is determined that the determination condition is satisfied, and the process proceeds to step S12. In other words, the case in which the determination condition is satisfied is a case in which the electric pump 1 is operated at the resonance frequency. If the vibration detected by the acceleration sensor 61 is less than the threshold value, the process is terminated.

In step S12, the operation of the electric pump 1 is controlled such that the rotation rate of the electric motor 50 is reduced (in other words, the amount of current supplied to the electric motor 50 is reduced) and such that the opening degree of the solenoid valve 40 is increased (in other words, the amount of current supplied to the solenoid valve 40 is increased). Subsequently, steps S11 and S12 are repeatedly executed until it is determined as NO in step S11.

By increasing the opening degree of the solenoid valve 40, the displacement volume of the pump 10 is increased to increase the discharge amount per rotation. Therefore, even if the rotation rate of the electric motor 50 is reduced, the supply of the working oil at the flow amount and the pressure according to the command signal is maintained without reducing the flow amount of the working oil discharged by the pump 10. In other words, in step S12, the rotation rate of the electric motor 50 is reduced and the opening degree of the solenoid valve 40 is increased such that the flow amount of the working oil discharged by the pump 10 is maintained at (or does not fall below) the flow amount according to the command signal.

In addition, because the rotation rate of the electric motor 50 is reduced, it is possible to change the frequency of the vibration generated in the electric motor 50. By changing the frequency of the vibration of the electric motor 50, it is possible to suppress the vibration of the electric pump 1.

In step S12, the rotation rate of the electric motor 50 may be increased, and the opening degree of the solenoid valve 40 may be reduced. Even in such a case, it is possible to change the frequency of the vibration generated in the electric motor 50 and to suppress occurrence of the resonance while ensuring the required flow amount for the flow amount of the working oil discharged by the electric pump 1.

According to the above-described embodiment, the advantages described below are afforded.

With the electric pump system 100, when the vibration generated in the electric pump 1 becomes equal to or greater than the vibration threshold value, the rotation rate of the electric motor 50 is adjusted while maintaining a supply flow amount to the CVT 2. As a result, because the operation of the electric motor 50 in the resonance region in which resonance is caused can be avoided, it is possible to suppress the vibration in the electric pump 1.

Especially, in a case in which the pump is an unbalanced variable displacement vane pump, compared with a case in which the pump is a balanced pump, the vibration is more likely to be generated. Even in such a case, the electric pump system 100 according to this embodiment is particularly useful because the vibration can be suppressed by adjusting the operation condition.

Second Embodiment

Figure 4:
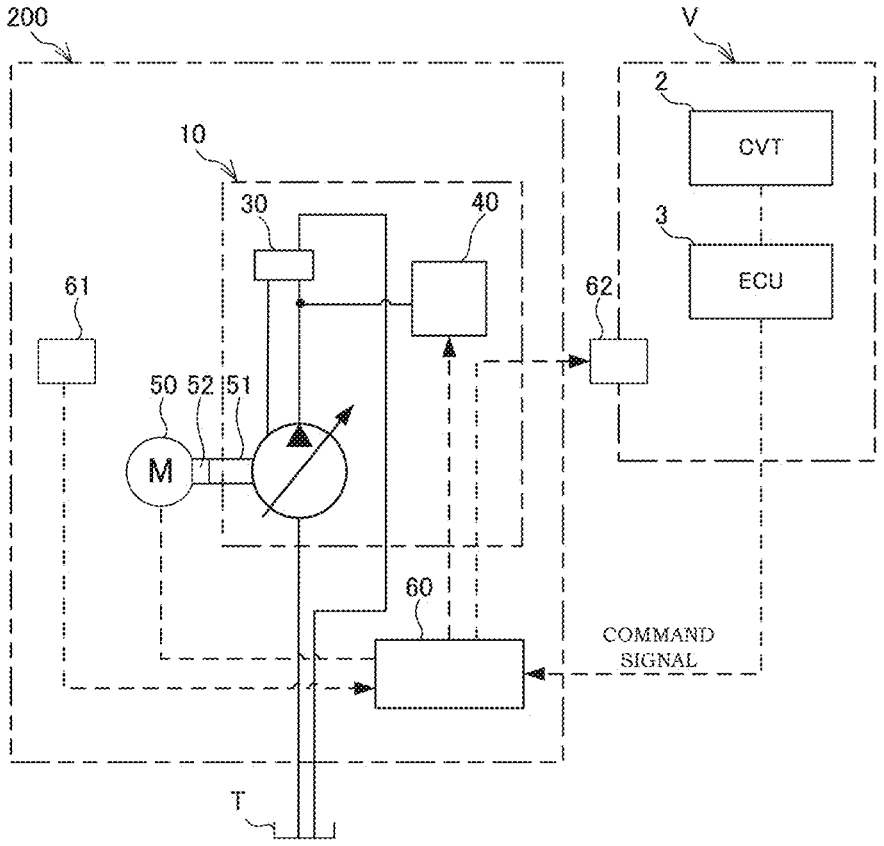
FIG. 4 is a block diagram showing the configuration of the electric pump system according to a second embodiment of the present invention.

Next, an electric pump system 200 according to a second embodiment of the present invention will be described with reference to FIGS. 4 to 6. In the following, differences from the above-described first embodiment will be mainly described, and the configurations that are the same as those in the above-described first embodiment are assigned the same reference numerals and descriptions thereof will be omitted.

In the above-described first embodiment, the electric pump system 100 has the acceleration sensor 61 that detects the vibration of the electric pump 1. The control device 60 controls the operation of the electric pump 1 by determining, as the determination condition, whether the vibration detected by the acceleration sensor 61 is equal to or greater than the vibration threshold value.

In contrast, in the electric pump system 200 according to the second embodiment, it is determined whether it is the operation condition (the determination condition) under which the vibration is likely to be generated by comparing the vibration generated in the pump 10, the electric motor 50, or the CVT 2. Specifically, as shown in FIG. 4, the electric pump system 200 according to the second embodiment has: a resolver 52 serving as a rotation detection unit that acquires the rotation rate of the electric motor 50; the first acceleration sensor 61 serving as a first vibration detection unit that detects the vibration of the pump 10; and a second acceleration sensor 62 serving as a second vibration detection unit that detects the vibration of the CVT 2. The control device 60 compares the vibration of the electric pump 1 with the vibration of the CVT 2, and, when the frequency bands in which the amplitude is increased are overlapped, adjusts the operation of the electric pump 1 by determining that the determination condition is satisfied. A description will be given specifically below.

Because the first acceleration sensor 61 has a similar configuration to that of the acceleration sensor 61 of the above-described first embodiment, the same reference numerals are assigned to the components, and detailed descriptions thereof will be omitted.

The second acceleration sensor 62 is, for example, attached to the vehicle V on which the electric pump system 100 is mounted, and detects the vibration of the CVT 2. The detection result from the second acceleration sensor 62 is input to the control device 60.

The resolver 52 is attached to the electric motor 50 and detects the rotation rate (rotation speed) of the electric motor 50. The detection result from the resolver 52 is input to the control device 60. In addition, because the pump 10 is connected to the electric motor 50, the rotation rate of the pump 10 can be calculated from the rotation rate of the electric motor 50. In this embodiment, the rotation rate of the pump 10 is the same as the rotation rate of the electric motor 50.

In the following, the control method of the electric pump 1 according to the second embodiment will be described.

Figure 5:
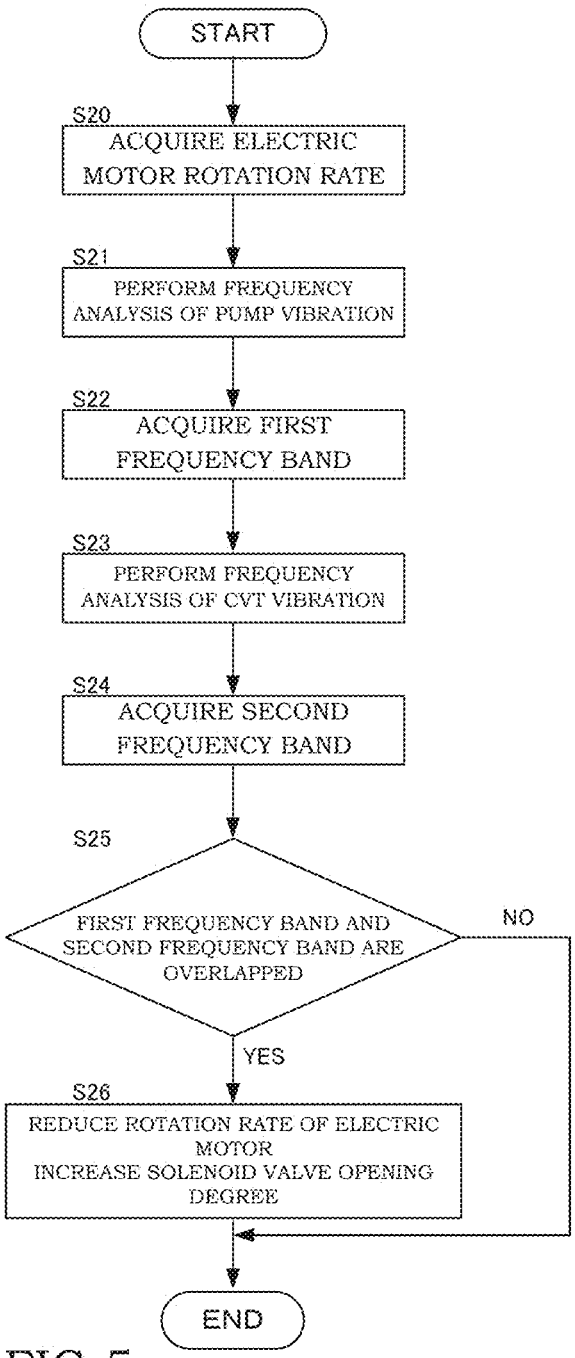
FIG. 5 is a flowchart showing the control method according to the second embodiment of the present invention.

In the second embodiment, the control device 60 executes the processing shown in FIG. 5.

In step S20, the rotation rate of the electric motor 50 is acquired.

Figure 6A:
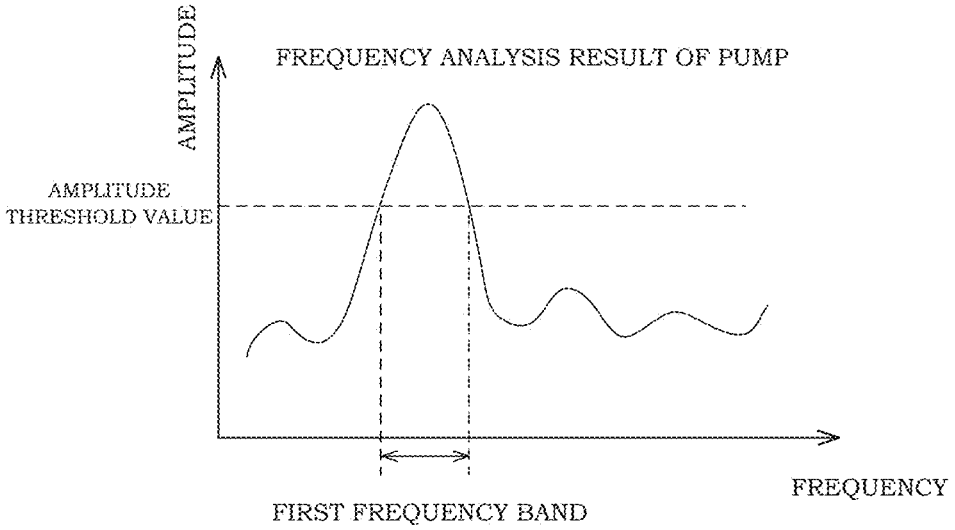
FIG. 6A is a graph showing vibration plotted with frequency on the horizontal axis and amplitude on the vertical axis, and is a diagram showing vibration generated in the pump.

In step S21, a frequency analysis of the vibration generated in the pump 10 is performed on the basis of the detection result from the first acceleration sensor 61, and the relationship between the frequency band and the amplitude is acquired on the basis of the rotation rate of the electric motor 50 (see FIG. 6(A)). The frequency analysis is performed by fast Fourier transform of the detection result from the first acceleration sensor 61.

In step S22, as shown in FIG. 6(A), from the relationship between the frequency band and the amplitude acquired in step S21, the frequency band in which the amplitude is equal to or greater than a predetermined first amplitude threshold value (hereinafter, referred to as "a: first frequency band") is acquired.

In step S23, similarly to step S21, the frequency analysis of the vibration generated in the CVT 2 is performed on the basis of the detection result from the second acceleration sensor 62, and the relationship between the frequency band and the amplitude is acquired on the basis of the rotation rate of the electric motor 50.

Figure 6B:
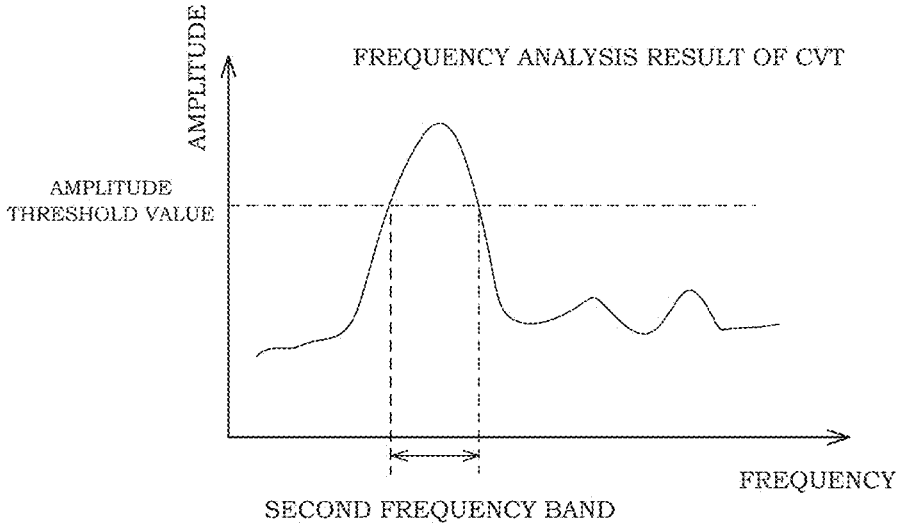
FIG. 6B is a graph showing vibration plotted with frequency on the horizontal axis and amplitude on the vertical axis, and is a diagram showing vibration generated in a CVT.

In step S24, similarly to step S22, as shown in FIG. 6(B), from the relationship between the frequency band and the amplitude acquired in step S23, the frequency band in which the amplitude is equal to or greater than a predetermined second amplitude threshold value (hereinafter, referred to as "a second frequency band") is acquired.

In step S25, it is determined whether the first frequency band acquired in step S22 overlaps with the second frequency band acquired in step S24.

Here, when a region (the first frequency band), in which the amplitude of the vibration of the pump 10 is increased, and a region (the second frequency band), in which the amplitude of the vibration of the CVT 2 is increased, are overlapped, it is considered that resonance is caused in the overlapped frequency band, and as a result, the amplitude is increased. In other words, when the increase in the amplitude is caused in both of the pump 10 and the CVT 2 in the common frequency band, it is considered that the resonance is caused. Thus, by determining whether the first frequency band and the second frequency band are overlapped, it is possible to determine whether is increased resonance is caused.

Although when low vibration having a small amplitude is generated on the pump 10 side, depending on the natural frequency of the CVT 2, there may be a case in which the vibration is amplified as it is transmitted to the CVT 2 side, and only the CVT 2 side is subjected to a high vibration having a large amplitude. In such a case, it is preferable to provide the acceleration sensor 61 on the side of the vehicle V, such as the CVT 2, etc., which is the driving target object, and to perform the determination by using the control as in the first embodiment.

When the first frequency band and the second frequency band are at least partially overlapped, it is determined that the determination condition is satisfied, and the process proceeds to step S26. If it is determined that the determination condition is not satisfied, the process is terminated.

Step S26 is the similar to step S12 in the first embodiment. When step S26 is executed, the first embodiment is terminated. As described above, by changing the operation condition of the electric pump 1, it is possible to suppress the cause of the resonance.

According to the above-described embodiment, the advantages described below are afforded.

In the electric pump system 200, when the amplitudes of the electric pump 1 and the CVT 2 are high in the common frequency band, it is determined that the resonance is caused and the operation of the electric pump 1 is adjusted. As a result, the operation of the electric pump 1 in the resonance region in which resonance is caused can be avoided, and so, it is possible to suppress the vibration of the electric pump 1 and the CVT 2.

Next, a modification of the second embodiment will be described.

In the above-described second embodiment, when the region (the first frequency band), in which the amplitude of the vibration of the pump 10 is increased, and the region (the second frequency band), in which the amplitude of the vibration of the CVT 2 is increased, are overlapped, the operation of the electric pump 1 is controlled to suppress the vibration. In contrast, the vibration may be reduced by controlling the operation of the electric pump 1 such that the order component of the vibration of the pump 10 and the order component of the vibration of the electric motor 50 do not overlap. A description will be given specifically below.

The frequency f of the order component is represented by $f=n\times z\times N/60$ [Hz], wherein: n is an order; z is the number of vanes for the pump 10, or z is any of the number of slots, the number of poles, and the least common multiple of the number of slots and the number of poles for the electric motor 50; N is the rotation rate; and f is the frequency of the order component. The rotation rates of the pump 10 and the electric motor 50 can be acquired from the detection result from the resolver 52. For example, when the rotation rate is 600 [rpm] and the number of vanes of the pump 10 is 10, the frequency of a first order component (the order component) of the pump 10 is $f=1\times10\times600/60=100$ [Hz].

The control device 60 calculates the frequency f of the order component for the first order to a predetermined order (for example, sixth order) for each of the pump 10 and the electric motor 50. The frequency of the order component may be calculated up to an arbitrarily predetermined order as described above, or the frequency of the order component may be calculated up to a predetermined frequency (for example, 3000 Hz). The control device 60 then compares each frequency of the order component of the vibration of the pump 10 with each frequency of the order component of the vibration of the electric motor 50, and when they are overlapped, the control device 60 determines that the determination condition is satisfied and controls the operations of the pump 10 and the electric motor 50. Specifically, the control device 60 controls the rotation rate of the electric motor 50. By changing the rotation rate of the electric motor 50, the frequency of the pump 10 and the frequency of the electric motor 50, which were overlapped, for the order component will diverge. As a result, it is possible to reduce the vibration of the electric pump 1.

In the comparison of the respective order components, not only the determination of whether the order components coincide with each other, but also the determination of whether the difference or the ratio of the order components is equal to or less than a predetermined value may be performed. In other words, the meaning of the phrase "the frequencies overlap with each other" is not limited to a case in which the frequencies coincide with each other, and also includes a case in which the difference of the frequencies is equal to or less than a predetermined value or in which the ratio of the frequencies falls within a predetermined range. From another point of view, in this description, the phrase "two frequencies are overlapped" means that a predetermined frequency regions, which are each set to have a numerical range including each of the frequencies, are overlapped with each other.

In addition, instead of or in addition to the comparison of the order components of the frequencies of the pump 10 and the electric motor 50, the control device 60 may determine whether the determination condition is satisfied by comparing the resonance frequency region of the CVT 2 (the driving target object) with the respective order component(s) of the frequency(ies) of the pump 10 and/or the electric motor 50 described above. In this case, when the resonance frequency region of the CVT 2 overlaps with the respective order component(s) of the frequency(ies) of the pump 10 and/or the electric motor 50, the control device 60 determines that the determination condition is satisfied and controls the operations of the pump 10 and the electric motor 50. The resonance frequency region is set on the basis of the natural frequency of the CVT 2, and this is stored in advance in the control device 60. As a result, because the overlap between the resonance frequency region of the CVT 2, etc. and the order component(s) of the pump 10 and/or the electric motor 50 can be avoided, it is possible to suppress the vibration due to the resonance.

In the following, a method of setting the resonance frequency region will be described specifically. The acceleration sensor is first provided on the CVT 2 that is the driving target object, and the vibration data is acquired by sweeping the rotation rate of the pump 10 or the electric motor 50. Then, the vibration data is subjected to the frequency analysis, and from the frequency-amplitude-time (the rotation rate) graph, a certain frequency component (for example, 500 Hz) in which the vibration is always large even when the rotation rate is swept is specified as the resonance frequency region. If the resonance is to be suppressed for the electric pump system 200 instead of the driving target object, such as the CVT 2, etc., this can be achieved by applying the method described above to the electric pump system 200 instead of the CVT 2.

Third Embodiment

Next, an electric pump system 300 according to a third embodiment of the present invention will be described with reference to FIGS. 7 and 8. In the following, differences from the above-described first embodiment will be mainly described, and the configurations that are the same as those in the above-described first embodiment are assigned the same reference numerals and descriptions thereof will be omitted.

The electric pump system 300 according to the third embodiment does not includes the acceleration sensor 61 in the above-described first embodiment, and the first acceleration sensor 61 and the second acceleration sensor 62 in the second embodiment. Other configurations are the similar to those in the above-described first embodiment. In other words, the electric pump system 300 according to the third embodiment has a structure in which the configuration of the acceleration sensor 61 is removed from the structure shown in FIG. 1.

In the electric pump system 300, a control map (see FIG. 8) that indicates a combination of the rotation rate of the electric motor 50 and the opening degree of the solenoid valve 40 that causes the resonance is stored in the control device 60 in advance. When the electric pump 1 is operated under the operation condition that causes the resonance included in the control map, it is determined that the determination condition is satisfied and the operation of the electric pump 1 is adjusted. A description will be given specifically below.

In the following, the control method of the electric pump 1 according to the third embodiment will be described.

Figure 7:
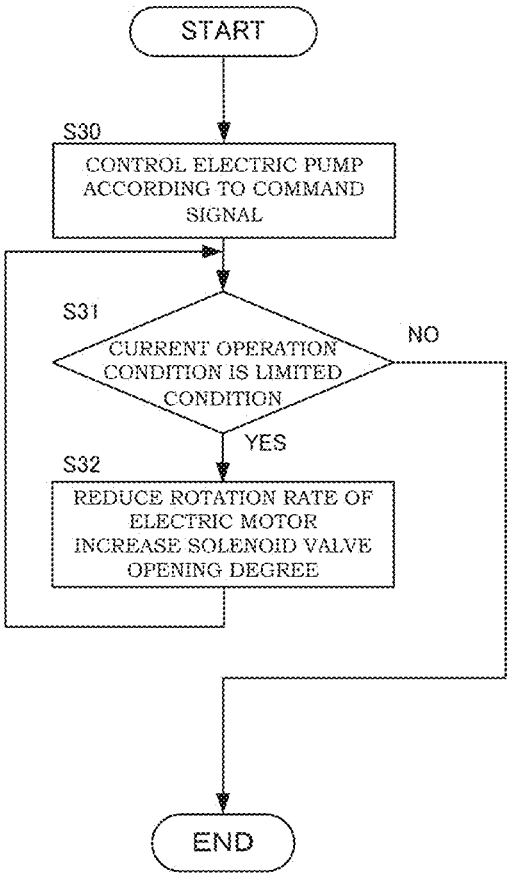
FIG. 7 is a flowchart showing the control method according to a third embodiment of the present invention.
Figure 8:
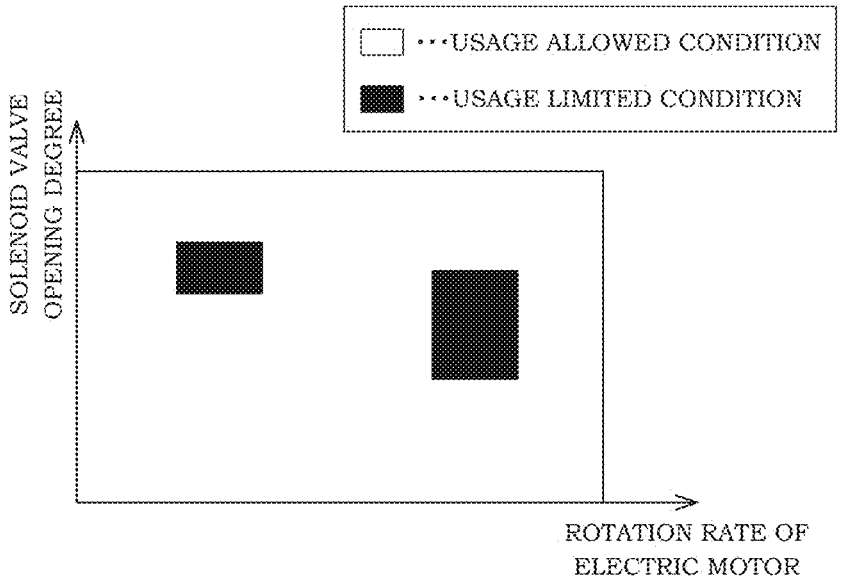
FIG. 8 is a diagram showing a control map according to the third embodiment of the present invention.

In the third embodiment, the control device 60 executes the processing shown in FIG. 7.

Because step S30 is similar to step S10 in the first embodiment (see FIG. 5), the description thereof will be omitted.

In step S31, the combination of the rotation rate of the electric motor 50 and the opening degree of the solenoid valve 40 (hereinafter, referred to as a "current operation condition") is compared with the control map. As shown in FIG. 8, the control map includes a usage allowed condition that is the operation condition under which it is possible to use of the electric pump 1 without generating the vibration with the amplitude equal to or greater than a predetermined level to the electric pump 1 or the CVT 2 (the vehicle V) and a usage limited condition under which the vibration with the amplitude equal to or greater than a predetermined level is generated and the use the electric pump 1 is limited. When the current operation condition matches the usage limited condition included in the control map, it is determined that the determination condition is satisfied and the process proceeds to step S32, and thereby, the operation of the electric pump 1 is controlled. Step S32 is similar to step S26 in the above-described first embodiment (see FIG. 5). Thereafter, steps S31 and S32 are repeatedly executed until it is determined as "NO" in step S31. When the current operation condition matches the usage allowed condition included in the control map, the process is terminated.

It is possible to create the control map by conducting experiments in advance to investigate the combination of the rotation rate of the electric motor 50 and the opening degree of the solenoid valve 40 with which the resonance is caused and the vibration is increased.

Also with the third embodiment described above, because the operation of the electric pump 1 under the operation condition that causes the resonance is avoided, it is possible to suppress the generation of the vibration.

Next, modifications of present embodiments will be described. The following modifications also fall within the scope of the present invention, and it is also possible to combine the configurations shown in the modifications with the configurations described in the above embodiments, or to combine the configurations described in the following different modifications with each other.

The vibration detection unit in the above-described first embodiment, the first vibration detection unit and the second vibration detection unit in the second embodiment are each the acceleration sensor. In contrast, the vibration detection unit, the first vibration detection unit, and the second vibration detection unit may be any devices as long as they can detect vibration, and for example, it may be possible to employ a sound wave meter that detects sound waves generated by vibration.

In addition, in each of the embodiments described above, although both of the opening degree of the solenoid valve 40 and the rotation rate of the electric motor 50 are adjusted when the determination condition is satisfied, only one of them may be adjusted. If only the adjustment of the opening degree of the solenoid valve 40 is to be performed, the control, in which the opening degree of the solenoid valve 40 is reduced to reduce the discharge capacity of the pump 10, is executed within a range in which the required flow amount is supplied to the CVT 2. Similarly, when only the adjustment of the rotation rate of the electric motor 50 is to be performed, the control, in which the rotation rate of the electric motor 50 is reduced, is executed within a range in which the flow amount required for the CVT 2 is supplied.

The above-described first embodiment, the second embodiment, and the third embodiment are not mutually exclusive configurations and may be combined with each other. Two embodiments selected from three embodiments may be combined, or all of the embodiments may be combined.

The configurations, operations, and effects of the embodiment of the present invention will be collectively described below.

The electric pump system 100, 200, 300 includes: the pump 10 configured such that the discharge flow rate is controlled in accordance with the opening degree of the solenoid valve 40, the operation of the solenoid valve 40 being controlled by energization; the electric motor 50 configured to drive the pump 10; and the control device 60 configured to control the operations of the solenoid valve 40 of the pump 10 and the electric motor 50 based on the command signal indicating the required discharge flow rate or the required discharge pressure of the pump 10, wherein the control device 60 is configured to adjust the operation of at least one of the solenoid valve 40 and the electric motor 50 when the determination condition, which is for determination of whether a predetermined vibration is generated in the electric pump system 100, 200, 300 or the CVT 2, is satisfied.

With this configuration, when the solenoid valve 40 and the electric motor 50 are operated under the operation condition under which a predetermined vibration is generated, the operation of at least one of the solenoid valve 40 and the electric motor 50 is adjusted. As a result, it is possible to suppress the generation of the vibration of the electric pump system 100. In addition, because the operation condition includes two parameters, i.e., the opening degree of the solenoid valve 40 and the rotation rate of the electric motor 50, compared with a case in which only one parameter is included, it becomes easier to operate the electric pump system 100 under the operation condition capable of suppressing the vibration, while ensuring the required flow amount of the working oil.

In addition, the electric pump system 100 is attached with the pump 10, the electric motor 50, and the pump 10 and has the acceleration sensor 61 configured to detect the vibration of any of the target objects to which the working fluid discharged from the pump 10 is supplied, wherein the control device 60 is configured to adjust the operation of at least one of the solenoid valve 40 and the electric motor 50 by determining that the determination condition is satisfied when the detection result from the acceleration sensor 61 exceeds a predetermined threshold value.

With this configuration, because the operations of the solenoid valve 40 and the electric motor 50 is adjusted on the basis of the detected vibration, it is possible to suppress the vibration more reliably.

In addition, the electric pump system 200 includes: the first acceleration sensor 61 configured to detect the vibration of the pump 10 or the electric motor 50; and the second acceleration sensor 62 configured to detect the vibration of the CVT 2 attached to the pump 10 to which the working oil discharged from the pump 10 is supplied, wherein the control device 60 is configured to: acquire the first frequency band in which the amplitude is equal to or greater than a predetermined first amplitude threshold value based on the detection result from the first vibration detection unit; acquire the second frequency band in which the amplitude is equal to or greater than a predetermined second amplitude threshold value based on the detection result from the second vibration detection unit; and adjust the operation of at least one of the solenoid valve 40 and the electric motor 50 by determining that the determination condition is satisfied when the first frequency band and the second frequency band are at least partially overlapped.

In addition, in the electric pump system 200, the control device 60 performs the frequency analysis on each of the results from the first acceleration sensor 61 and the second acceleration sensor 62 and compares the first frequency band and the second frequency band so as to determine whether they are overlapped.

With these configurations, by performing the determination on the basis of the vibrations of both of the electric pump system 200 and the CVT 2, it is possible to determine the resonances of the electric pump system 200 and the CVT 2, and to suppress the vibrations of the electric pump system 200 and the vehicle V as a whole.

In addition, with the electric pump system 300, the control map indicating the usage allowed condition under which the vibration equal to or greater than a predetermined level is not generated and the usage limited condition under which the vibration equal to or greater than a predetermined level is generated for the combination of the rotation rate of the electric motor 50 and the opening degree of the solenoid valve 40 is stored in the control device 60, and the control device 60 is configured to adjust the operation of at least one of the solenoid valve 40 and the electric motor 50 by determining that the determination condition is satisfied when the solenoid valve 40 and the electric motor 50 are operated under the operation condition under which the usage is limited.

With this configuration, even if the sensor, etc. for detecting the vibration is not used, it is possible to avoid the operation of the electric pump 1 under the operation condition that is likely to generate the vibration.

In addition, the electric pump system 200 further includes the resolver 52 configured to detect the rotation rate of the electric motor 50, wherein the pump 10 is a vane pump, and the control device 60 is configured to: calculate the frequency of the order component of the vibration of the pump 10 based on the number of vanes of the pump 10 and the detection result from the resolver 52; calculate the frequency of the order component of the vibration of the electric motor 50 based on any of the number of slots, the number of poles, and the least common multiple of the number of slots and the number of poles of the electric motor 50 and the detection result from the resolver 52; and adjust the operation of at least one of the solenoid valve 40 and the electric motor 50 by determining that the determination condition is satisfied when the frequency of the order component of the vibration of the pump 10 and the frequency of the order component of the vibration of the electric motor 50 are overlapped.

With this configuration, it is possible to suppress the vibration which is amplified by the overlap of the frequencies of the order components of the pump 10 and the electric motor 50.

In addition, in the electric pump system 200, the resonance frequency region, which is the natural frequency of the CVT 2, is stored in advance in the control device 60, and the control device 60 is configured to adjust the operation of at least one of the solenoid valve 40 and the electric motor 50 by determining that the determination condition is satisfied when at least one of the frequency of the order component of the vibration of the pump 10 and the frequency of the order component of the vibration of the electric motor 50 overlaps with the resonance frequency region.

With this configuration, it is possible to suppress the amplification of the resonance vibration of the electric pump system 200 and the CVT 2.

In addition, in the electric pump system 100, 200, 300, the control device 60 is configured to, when the determination condition is satisfied, in order to ensure the required discharge flow rate of the pump 10, reduce the opening degree of the solenoid valve 40 and increase the rotation rate of the electric motor 50, or to increase the opening degree of the solenoid valve 40 and reduce the rotation rate of the electric motor 50.

With this configuration, it is possible to suppress the generation of the vibration by changing the frequencies of the vibrations of both of the pump 10 and the electric motor 50 while supplying the required flow amount to the CVT 2.

Embodiments of this invention were described above, but the above embodiments are merely examples of applications of this invention, and the technical scope of this invention is not limited to the specific constitutions of the above embodiments.

This application claims priority based on Japanese Patent Application No. 2022-59450 filed with the Japan Patent Office on Mar. 31, 2022, the entire contents of which are incorporated into this specification.

The invention claimed is:

1. An electric pump system for supplying working fluid to a driving target object, the electric pump system comprising:

a pump configured such that a discharge flow rate is controlled in accordance with an opening degree of a solenoid valve, operation of the solenoid valve being controlled by energization;

an electric motor configured to drive the pump; and a control device configured to control the operation of the solenoid valve of the pump and operation of the electric motor based on a command signal indicating a required discharge flow rate or a required discharge pressure of the pump, wherein the control device is configured to adjust the operation of at least one of the solenoid valve and the electric motor when a determination condition is satisfied, the determination condition being set based on vibration generated in the electric pump system or the driving target object, and the control device is further configured to, when the determination condition is satisfied, in order to ensure the required discharge flow rate of the pump, reduce the opening degree of the solenoid valve and increase the rotation rate of the electric motor, or to increase the opening degree of the solenoid valve and reduce the rotation rate of the electric motor.

2. The electric pump system according to claim 1, further comprising a vibration detection unit configured to detect vibration of any of the pump, the electric motor, and the driving target object, wherein the control device is configured to adjust the operations of at least one of the solenoid valve and the electric motor by determining that the determination condition is satisfied when a detection result from the vibration detection unit exceeds a predetermined threshold value.

3. The electric pump system according to claim 1, further comprising:

a first vibration detection unit configured to detect vibration of the pump or the electric motor; and a second vibration detection unit configured to detect vibration of the driving target object, wherein the control device is configured to:

acquire a first frequency band in which amplitude is equal to or greater than a predetermined first amplitude threshold value based on a detection result from the first vibration detection unit;

acquire a second frequency band in which amplitude is equal to or greater than a predetermined second amplitude threshold value based on a detection result from the second vibration detection unit; and adjust the operations of at least one of the solenoid valve and the electric motor by determining that the determination condition is satisfied when the first frequency band and the second frequency band are at least partially overlapped.

4. The electric pump system according to claim 1, wherein a resonance frequency region, which is a natural frequency of the driving target object, is stored in advance in the control device, and the control device is configured to adjust the operations of at least one of the solenoid valve and the electric motor by determining that the determination condition is satisfied when at least one of the frequency of the order component of the vibration of the pump and the frequency of the order component of the vibration of the electric motor overlaps with the resonance frequency region.

5. An electric pump system for supplying working fluid to a driving target object, the electric pump system comprising:

a pump configured such that a discharge flow rate is controlled in accordance with an opening degree of a solenoid valve, operation of the solenoid valve being controlled by energization;

an electric motor configured to drive the pump;

a control device configured to control the operation of the solenoid valve of the pump and operation of the electric motor based on a command signal indicating a required discharge flow rate or a required discharge pressure of the pump; and a rotation detection unit configured to detect a rotation rate of the electric motor, wherein the control device is configured to adjust the operation of at least one of the solenoid valve and the electric motor when a determination condition is satisfied, the determination condition being set based on vibration generated in the electric pump system or the driving target object, the pump is a vane pump, and the control device is further configured to calculate a frequency of an order component of the pump based on a number of vanes of the pump and a detection result from the rotation detection unit;

calculate a frequency of an order component of the electric motor based on any of a number of slots, a number of poles, and a least common multiple of the number of slots and the number of poles of the electric motor, and on the detection result from the rotation detection unit; and adjust the operations of at least one of the solenoid valve and the electric motor by determining that the determination condition is satisfied when the frequency of the order component of the pump and the frequency of the order component of the electric motor are overlapped.

6. An electric pump system for supplying working fluid to a driving target object, the electric pump system comprising:

a pump configured such that a discharge flow rate is controlled in accordance with an opening degree of a solenoid valve, operation of the solenoid valve being controlled by energization;

an electric motor configured to drive the pump; and a control device configured to control the operation of the solenoid valve of the pump and operation of the electric motor based on a command signal indicating a required discharge flow rate or a required discharge pressure of the pump, wherein the control device is configured to adjust the operation of at least one of the solenoid valve and the electric motor when a determination condition is satisfied, the determination condition being set based on vibration generated in the electric pump system or the driving target object, a control map indicating a usage limited condition under which vibration equal to or greater than a predetermined level is generated for a combination of the rotation rate of the electric motor and the opening degree of the solenoid valve is stored in the control device, and the control device is further configured to adjust the operations of at least one of the solenoid valve and the electric motor by determining that the determination condition is satisfied when the solenoid valve and the electric motor are operated under the usage limited condition.

* * * * *